US007510480B2

(12) United States Patent
Lesko

(10) Patent No.: US 7,510,480 B2
(45) Date of Patent: Mar. 31, 2009

(54) GOLF SWING TRAINING DEVICE

(76) Inventor: John Joseph Lesko, 22 Hill gate Pl., Aliso Viejo, CA (US) 92656

( * ) Notice: Subject to any disclaimer, the term of this patent is extended or adjusted under 35 U.S.C. 154(b) by 0 days.

(21) Appl. No.: 11/646,015

(22) Filed: Dec. 27, 2006

(65) Prior Publication Data

US 2007/0155523 A1 Jul. 5, 2007

Related U.S. Application Data

(60) Provisional application No. 60/754,370, filed on Dec. 27, 2005.

(51) Int. Cl.
*A63B 69/36* (2006.01)

(52) U.S. Cl. ..... 473/212; 473/276

(58) Field of Classification Search ..... 473/207, 473/212, 213, 214, 226, 227, 276
See application file for complete search history.

(56) References Cited

U.S. PATENT DOCUMENTS

| | | | | |
|---|---|---|---|---|
| 3,423,095 | A | 1/1969 | Cox | |
| 3,700,245 | A | 10/1972 | Nannini | |
| 4,241,922 | A | 12/1980 | Elliott, Jr. | |
| 4,245,841 | A * | 1/1981 | Owens, Jr. | 473/212 |
| 4,451,044 | A | 5/1984 | Elliott, Jr. | |
| 4,502,688 | A | 3/1985 | Papp | |
| 5,158,298 | A | 10/1992 | Goins | |
| 5,207,430 | A | 5/1993 | Goins | |
| 5,277,427 | A | 1/1994 | Bryan et al. | |
| 5,309,573 | A | 5/1994 | Solar et al. | |
| 5,390,928 | A | 2/1995 | Salini | |
| 5,445,383 | A | 8/1995 | Gleason, Jr. | |
| 5,501,464 | A | 3/1996 | Dalbo | |
| 5,634,854 | A | 6/1997 | Albertsson | |
| 5,743,805 | A * | 4/1998 | Richter | 473/213 |
| 5,746,662 | A | 5/1998 | Squire | |
| 5,868,632 | A | 2/1999 | Drelick | |
| 6,007,341 | A | 12/1999 | Koch | |
| 6,196,930 | B1 | 3/2001 | Aumock | |
| 6,358,156 | B1 * | 3/2002 | Moran | 473/219 |
| 2003/0083140 | A1 | 5/2003 | Bamber | |
| 2004/0214652 | A1 * | 10/2004 | Robbins | 473/276 |

* cited by examiner

*Primary Examiner*—Nini Legesse
(74) *Attorney, Agent, or Firm*—Stetina Brunda Garred & Brucker

(57) ABSTRACT

A golf swing trainer comprising a golf club shaft configured to be held by a user and allows the user to execute a golf swing; and an arm attached to the golf club shaft, the arm being configured to be attached to the user's forearm, wherein when the user swings the golf club shaft, the user's forearm and the golf club shaft substantially fall in a single plane.

22 Claims, 15 Drawing Sheets

GOLF SWING TRAINING DEVICE

CROSS REFERENCE TO RELATED APPLICATIONS

This application is related to and claims the benefit of priority from U.S. provisional application Ser. No. 60/754,370 filed Dec. 27, 2005, the entire contents of which are incorporated herein.

FIELD OF THE INVENTION

The present invention relates to sports instruction devices, such as instruction devices intended to improve a golf swing.

BACKGROUND

In general, the object of the game of golf is to hole the ball in as few strokes as possible on each hole. Low golf scores can be accomplished in different ways. The most direct influence upon a golfer's score is their ability to strike a golf ball with accuracy, both in terms of distance and direction. A golfer's ability to strike a golf ball with accuracy can be improved by correcting the golfer's swing.

The golf swing has been analyzed extensively since the game began centuries ago. Many books have been written and articles published on the subject, all with the intention of helping the golfer improve. The golf swing is probably the most written about or dissected motion in all of sport. Along with written material, golfers can seek the help of a professional instructor or use a training device to help improve their golf swings.

Several golf training devices have been invented. For instance, U.S. Pat. No. 5,207,430 issued to Goins, U.S. Pat. No. 4,451,044 issued to Elliott, Jr., and U.S. Pat. No. 3,700,245 issued to Nannini disclose training apparatuses that include wrist guides configured to be positioned on the hand of a golfer. The wrist guides appear to be designed to prevent the wrist from moving forward relative to the forearm during the swing. At least one problem with these wrist guides is they may not effectively block the wrist from moving to an undesired position during the swing. The strength of some user's wrist may overcome the strength of these wrist guides. Sturdier ways of ensuring the desired position of the wrist during a golf swing are desired.

Another existing golf training device is disclosed in U.S. Pat. No. 5,390,928 issued to Salini (hereinafter the "Salini invention"). The Salini invention appears to disclose an elongated strap that can be worn by golfers around their wrists. The elongated strap is secured to a golf club by a side arm and a golf tee. At least one problem with the Salini invention is that the golf tee may not provide a secure attachment for the golf club and the side arm. Another problem is the side arm appears to be in a fixed position, which may pull the elongated strap away from the golfer's wrist when a golfer swings the golf club thereby causing discomfort to the golfer. The fixed position of the side arm may also prevent the user from freely hinging the wrist on the backswing. Golf swing trainers that allow users to freely hinge their wrists vertically or up and down during the backswing are desired.

The applicant has invented a golf swing trainer that includes features that the applicant believes are not disclosed in the existing devices above. The applicant has invented a golf swing trainer that may be more effective in improving a golfer's swing than the existing golf training devices and may not suffer from at least some of the cited disadvantages of the existing golf training devices.

BRIEF DESCRIPTION

A golf swing trainer comprising a golf club shaft configured to be held by a user and allows the user to execute a golf swing; and a training arm attached to the golf club shaft, the training arm being configured to be attached to the user's forearm, wherein when the user swings the golf club shaft, the user's forearm and the golf club shaft substantially fall in a single plane.

The above description sets forth, rather broadly, a summary of certain embodiments of the present invention so that the detailed description that follows may be better understood and contributions of the present invention to the art may be better appreciated. Some of the embodiments of the present invention may not include all of the features or characteristics listed in the above summary. There are, of course, additional features of the invention that will be described below and will form the subject matter of claims. In this respect, before explaining at least one preferred embodiment of the invention in detail, it is to be understood that the invention is not limited in its application to the details of the construction and to the arrangement of the components set forth in the following description or as illustrated in the drawings. The invention is capable of other embodiments and of being practiced and carried out in various ways. Also, it is to be understood that the phraseology and terminology employed herein are for the purpose of description and should not be regarded as limiting.

DETAILED DESCRIPTION

Figure 1:
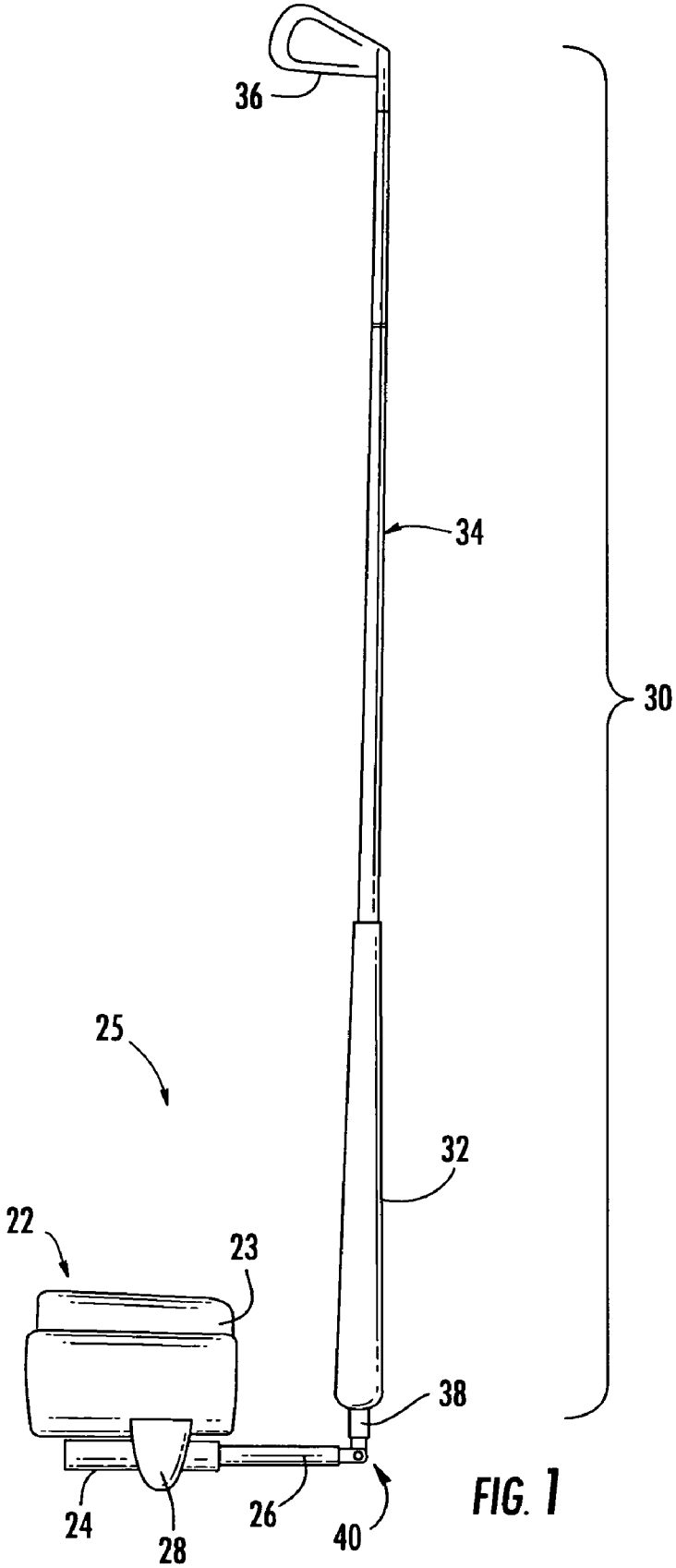
FIG. 1 is substantially a front elevational view of an embodiment of the golf swing trainer of the present invention.

In the following detailed description of the preferred embodiments, reference is made to the accompanying drawings, which form a part of this application. The drawings show, by way of illustration, specific embodiments in which the invention may be practiced. It is to be understood that other embodiments may be utilized and structural changes may be made without departing from the scope of the present invention. The applicant utilizes various spatially orienting terms, such as "top," "bottom," "proximal," and "distal." It is to be understood that these terms are used for ease of description of the preferred embodiments with respect to the drawings but are not necessarily in themselves limiting or requiring of an orientation as thereby described. For the sake of simplicity, the discussions herein assume the involvement, circumstances, and experiences of a right-handed golfer. This does not limit the use of the applicant's invention to right-handed golfers. The various embodiments of the applicant's invention may be used by both left and right-handed golfers.

The present invention comprises a golf swing trainer, generally indicated by reference number 25. Golf swing trainer 25 preferably includes a forearm brace 22, which preferably resembles a half-pipe having a substantially elliptical shaped cross-section 23. The elliptical shaped cross-section 23 of the forearm brace 22 is preferably designed to accommodate a user's forearm. A training arm receiver 24 is preferably attached to the forearm brace 22. A receiver mount 28 may be used to attach the training arm receiver 24 to the forearm brace 22. The training arm receiver 24 may be a tubular structure having a hollow interior. The hollow interior of the training arm receiver 24 is preferably configured to receive a training arm 26.

The training arm 26 may be attached to a golf club 30. The golf club 30 may include a golf grip 32, a shaft 34, and a club head 36. A club shaft extension 38 preferably attaches the golf club 30 to a hinge assembly 40, which is connected to the training arm 26. It is noted that, the golf club 30 may be replaced with any elongated structure, that may or may not be hollow and that may or may not have a cylindrical shape, such as a stick or a rod. Golf club 30 may not include the golf grip 32 and the club head 36.

Figure 2:
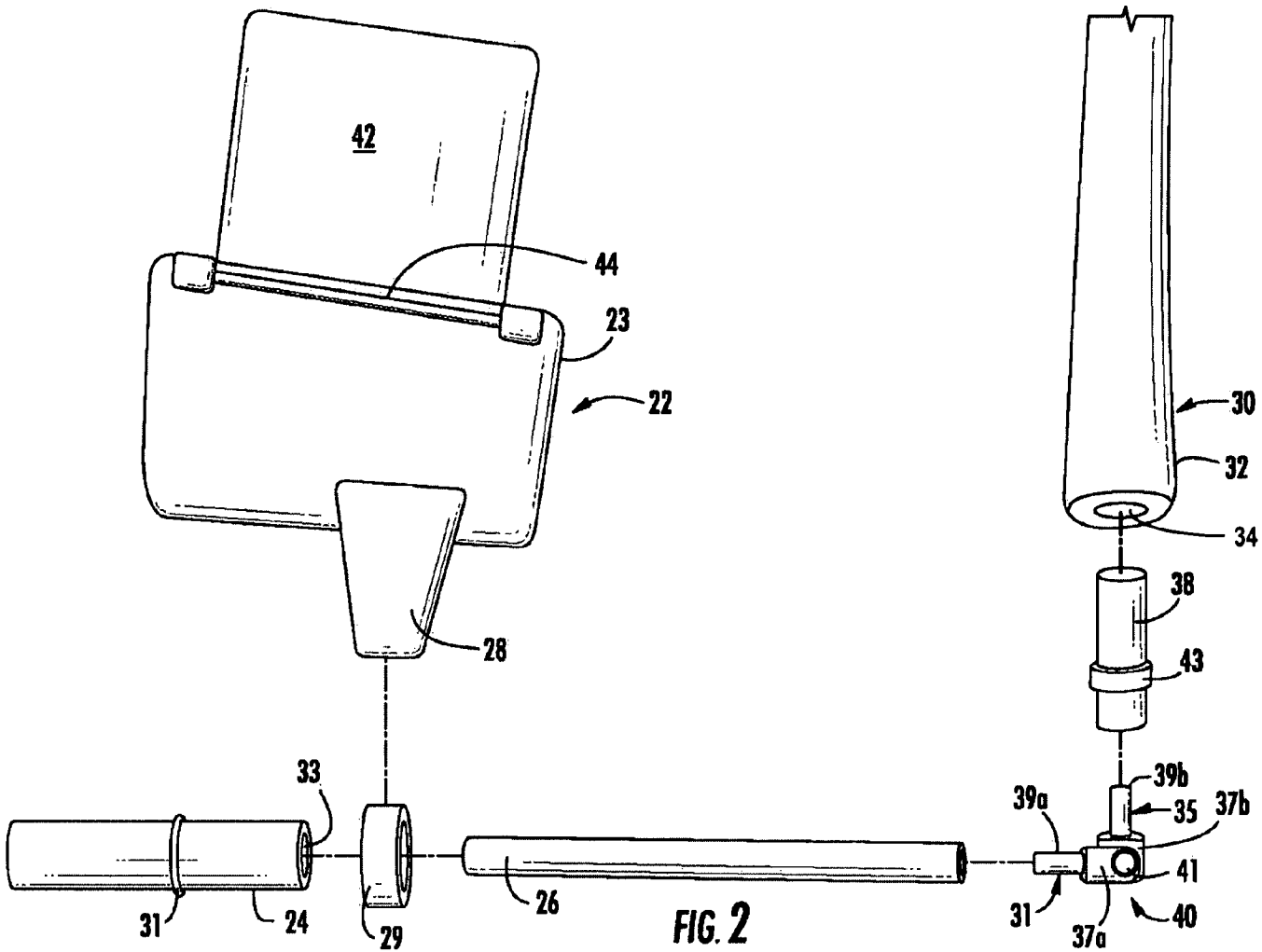
FIG. 2 is substantially a partial exploded view of the golf swing trainer embodiment shown in FIG. 1.
Figure 3:
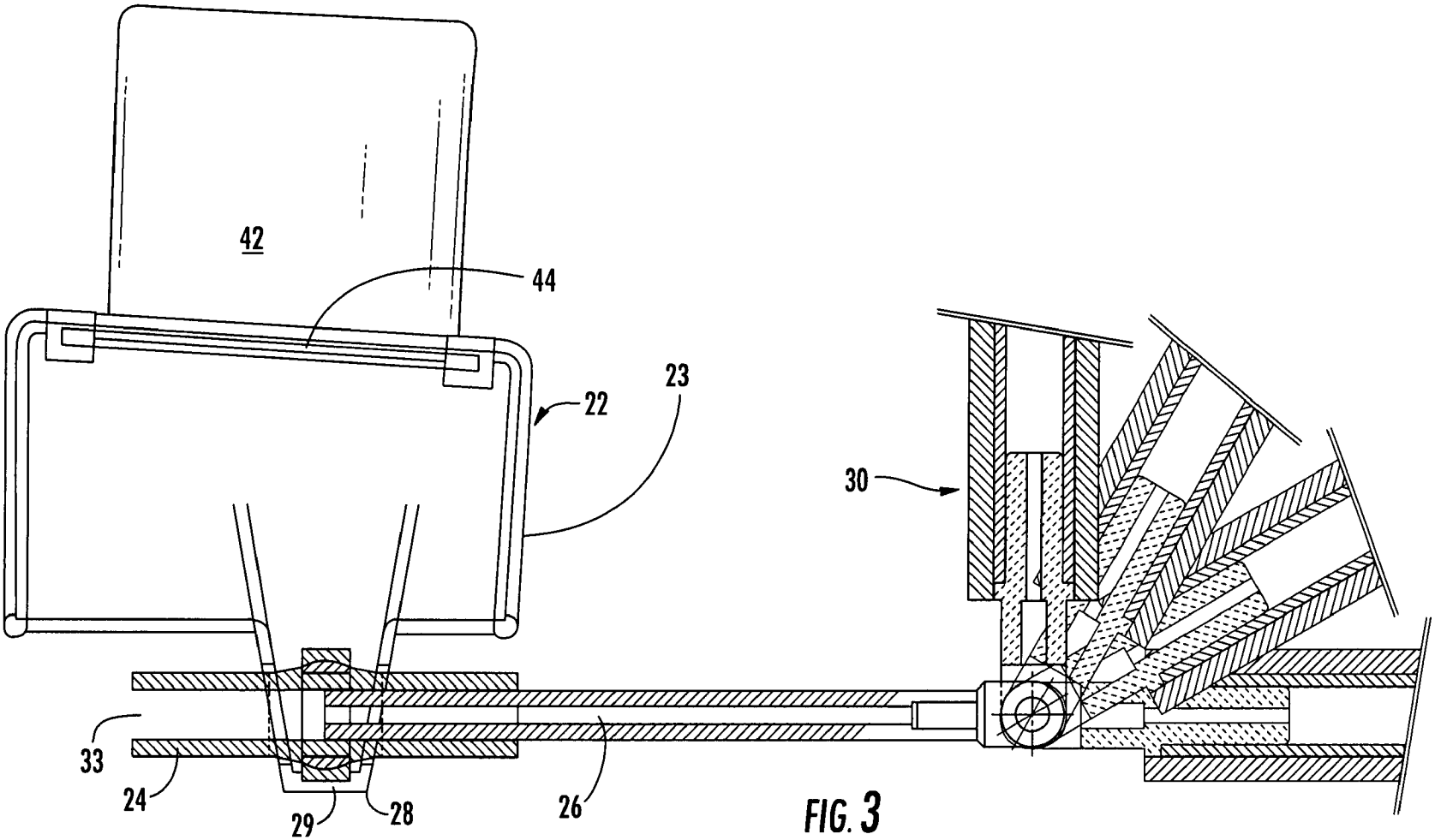
FIG. 3 is substantially a partial cross-sectional view of the golf swing trainer embodiment shown in FIG. 1.

With reference now to FIGS. 2 and 3, forearm brace 22 preferably includes a strap 42. Strap 42 preferably includes a strap fastener (not shown), which may be made of hook and loop fasteners, such as those sold under the trademark VELCRO, or other materials known the art. The strap 42 may be looped around a strap bar 44, which may be a rod attached parallel to the body of the forearm brace 22 or perpendicular to the substantially elliptical shaped cross section 23 of the forearm brace 22. A space may be provided in between the rod 44 and the forearm brace body to accommodate the insertion of the strap 42. It is understood that the number, placements, and shapes of straps may vary and still fall within the scope of the invention. For instance, multiple straps may be provided (not shown).

Forearm brace 22 preferably includes a receiver mount 28, which may be integral to the brace 22. The receiver mount 28 and the forearm brace 22 may be manufactured from a single casting mold and with polymers known in the art. The receiver mount 28 preferably defines a recess that traverses the body of the receiver mount 28 in the direction that is preferably parallel to the substantially elliptical shaped cross section 23 of the forearm brace 22.

The receiver mount 28 preferably includes a circular bearing 29 configured to be positioned within the confines of the receiver mount recess. The training arm receiver 24 is preferably inserted through the circular bearing 29 and the receiver mount recess. The training arm receiver 24 may include a circumferential protrusion 31 positioned substantially in between the training arm receiver ends. The circumferential protrusion 31 is preferably configured to be surrounded by the circular bearing 29, which may act as a flange securing the training arm receiver 24 within the bearing 29 and within the receiver mount recess that holds the bearing 29.

The training arm receiver 24 preferably includes a receiver recess 33 defined by the entire body of the receiver 24. Stated differently, the training arm receiver 24 is preferably hollow and includes a tubular wall defining the receiver recess 33. A training arm 26 is preferably configured to be inserted through the receiver recess 33. The training arm 26 and the receiver recess 33 are preferably shaped to provide a sliding fit for the training arm 26 to slide within the receiver recess 33.

The training arm 26 may be in a form of a tube, a shaft, a rod, or a stick, which may or may not be hollow. The training arm 26 may also be in a form of an extendable and retractable telescopic tube (not shown) that may be attached to the receiver 24 or directly to the brace body 22. The sizes, shapes, and the locations of the training arm 26 and the training arm receiver 24 may be varied.

A hinge assembly 40 preferably attaches the training arm 26 to the club shaft extension 38. The hinge assembly 40 may include a training arm end 31 and a golf club end 35. Each end 31 and 35 preferably includes its corresponding pin head 37*a* and 37*b* and end shaft 39*a* and 39*b*. The arm end 31 and the club end 35 are preferably joined by a pin 41 that is inserted through the pin heads 37*a* and 37*b*. The arm end 31 and the club end 35 are preferably moveably attached by the pin 41, which may allow the club end 35 to pivot from a position where it forms a 90 degree angle relative to the arm end 31 to a position where it forms a 180 degree angle relative to the arm end 31.

The club end 35 of the hinge assembly 40 preferably attaches to a club shaft extension 38. The club shaft extension 38 may be made of a tubular material that may have a hollow interior. The club end 35 may be inserted through the hollow interior of the club shaft extension 38, and the club shaft extension 38 may grip and fittingly hold the club end 35. The club extension 38 may be sized to fit within the confines of a recess defined by the golf club shaft 34. A portion of the golf club grip 32 may be used as a flange to hold the club shaft extension 38. The club shaft extension 38 may include a circumferential protrusion 43 configured to be engaged by the confines of the shaft of the golf club. Based on the attachment of the training arm 26 and the golf club 30 to the hinge, it can be realized that the movement of the components of the hinge allows the golf club 30 to preferably hinge from a position where it forms a 90 degree angle relative to the training arm 26 to a position where it forms a 180 degree angle relative to the training arm 26 (FIG. 3) during the golf swing.

Figure 4:
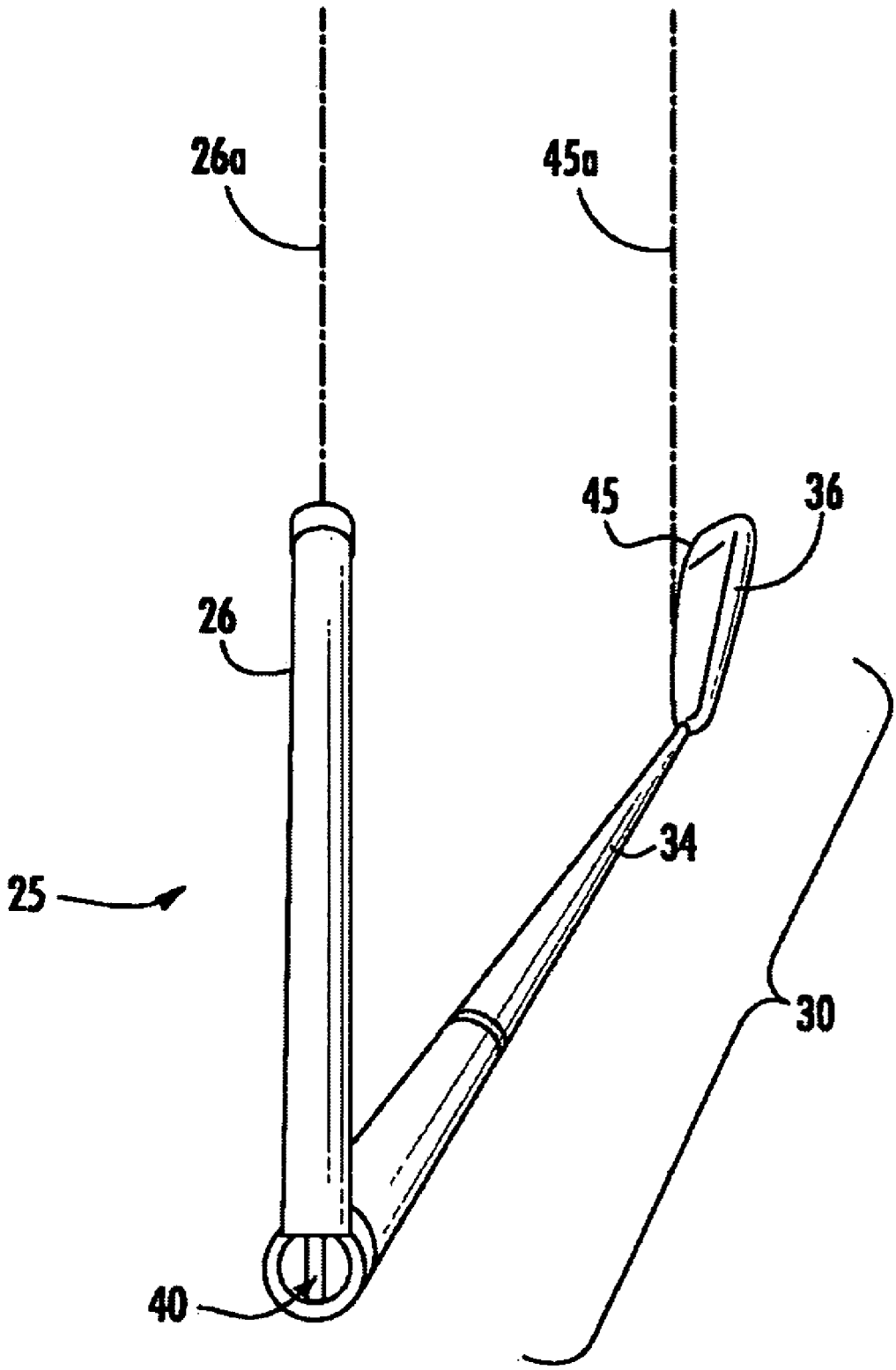
FIG. 4 is substantially a top view of the golf swing training device showing the training arm in alignment with the leading edge of the golf club head.

Referring now to FIG. 4, to promote the underlying golf swing principle discussed below, the golf swing trainer 25 preferably includes a golf club 30 having a club head 36 with a leading edge 45. The leading edge 45 may define a leading edge axis 45*a*. The training arm may define a centerline axis 26*a*. The leading edge axis 45*a* and the centerline axis 26*a* are preferably parallel to each other. Note that the hinge assembly 40 is also preferably parallel to the leading edge of the golf club head 45. The leading edge axis 45*a* and the centerline axis 26*a* preferably fall on a single plane. The hinge assembly 40, whether permanently or temporarily affixed to the golf club shaft 34, is preferably designed to operate such that the golf club 30 and the training arm 26 joined to the hinge assembly 40 move within the single plane. The training arm 26 and the hinge assembly 40, once attached to the golf club shaft, will not be able to move out of the single plane. Stated differently, the hinge assembly 40 and the training arm 26 are preferably positioned to operate in alignment with the leading edge 45 of the golf club head 36. With the hinge assembly 40, training arm 26 and the leading edge 45 of the golf club head 36 having this orientation, an In-Line condition defined and described below can efficiently be promoted by the golf swing training device 25.

ANOTHER EMBODIMENT

Figure 5:
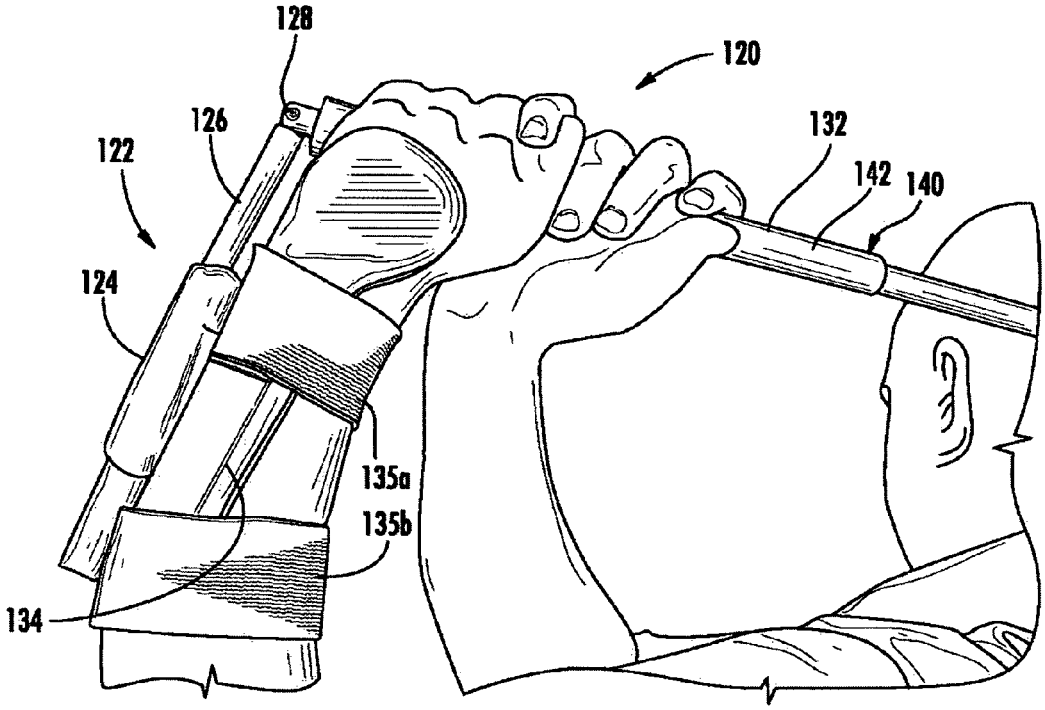
FIG. 5 is substantially a view of another embodiment of the golf swing trainer of the present invention being used by a user.

Referring now to FIG. 5, another embodiment of a golf swing trainer 120 is shown. Golf swing trainer 120 preferably includes a forearm brace 122, which is preferably configured to be worn by a user and positioned on an area on the user's forearm that is proximate to the user's wrist. The forearm brace 122 preferably includes straps 135*a* and 135*b*, which allow the user to secure the forearm brace 122 on said location.

Forearm brace 122 preferably also includes a training arm receiver 124. Receiver 124 is preferably a tubular structure having a hollow interior. Receiver 124 is preferably attached to the forearm brace 122 so that when the forearm brace 122 is worn by the user, the receiver 124 is in a position that is substantially below the ulna bone of the user and at least partially parallel to the forearm of the user. The hollow interior of the receiver 124 is preferably configured to receive training arm 126, which is a part of the golf swing trainer 120.

Training arm 126 may be in a form of a tube, a shaft, a rod, or a stick, which may or may not be hollow. Training arm 126 may also be in a form of an extendable and retractable telescopic tube (not shown) that may be attached directly to the brace body 134. The sizes, shapes, or locations of the training arm 126 and receiver 124 may be varied. Training arm 126 is preferably configured to be inserted in the receiver 124. A hinge assembly 128 is preferably attached to one end of the training arm 126 that is configured to be distal from the portion of the training arm 126 that is configured to go in the receiver 124. A golf club shaft 132 is preferably attached to the hinge assembly 128. Thus, training arm 126 and golf club shaft 132 are preferably attached through the hinge assembly 128.

It is noted that, while in the preferred embodiment, the golf club shaft 132 is a conventional shaft of a conventional golf club, golf club shaft 132 may be replaced with any elongated structure, that may or may not be hollow and that may or may not have a cylindrical shape, such as a stick or a rod. Golf club shaft 132 may or may not include other components of a conventional golf club, such as a club head. In the preferred embodiment, the golf swing trainer 120 has a conventional golf club 140, which preferably includes a golf grip 142, a shaft 132, and a club head (not shown in FIG. 5).

Figure 6:
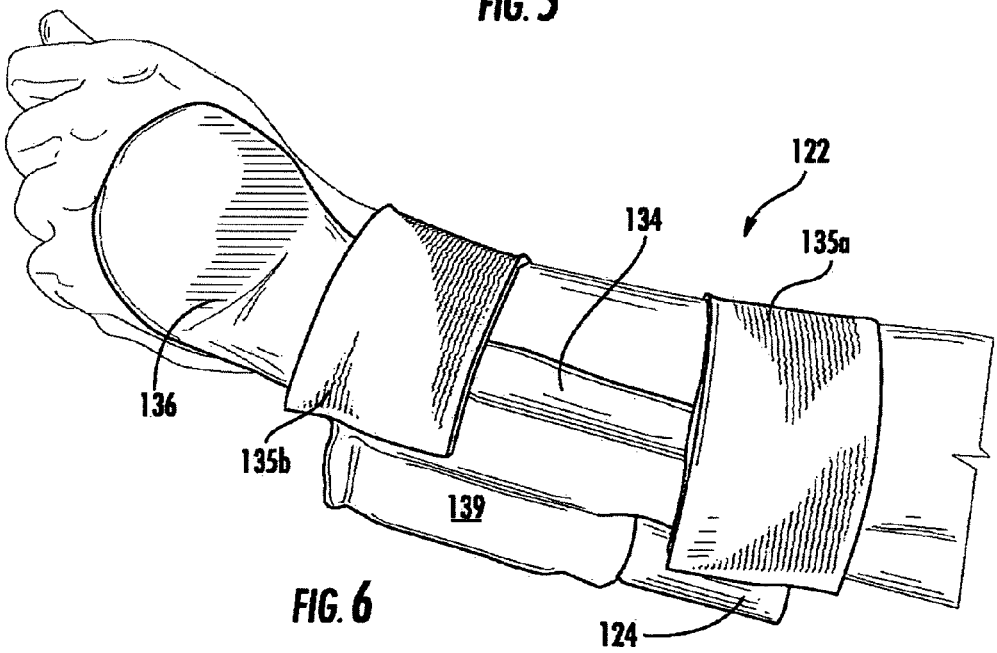
FIG. 6 is substantially a side view of an embodiment of an arm brace and receiver of the present invention.

With reference now to FIG. 6, forearm brace 122 preferably includes a brace body 134 that resembles a half-pipe having an elliptical shaped cross-section. The elliptical shaped cross-section of the brace body 134 is preferably designed to accommodate the user's forearm. Also preferably attached to the brace body 134 is the receiver 124. Receiver 124 is preferably shaped and sized to moveably fit training arm 126 (FIG. 5). Receiver 124 preferably does not exceed the length of a person's forearm. Receiver 124 is shown to preferably include a cylindrical or tubular shape. However, the shape or location of the receiver 124 may vary and still fall within the scope of the invention. Receiver 124 may be made separate from the brace body 134 or may be made from the same mold as the brace body 134, if brace body 134 and receiver 124 were to be made of plastic or any other moldable material.

Figure 18:
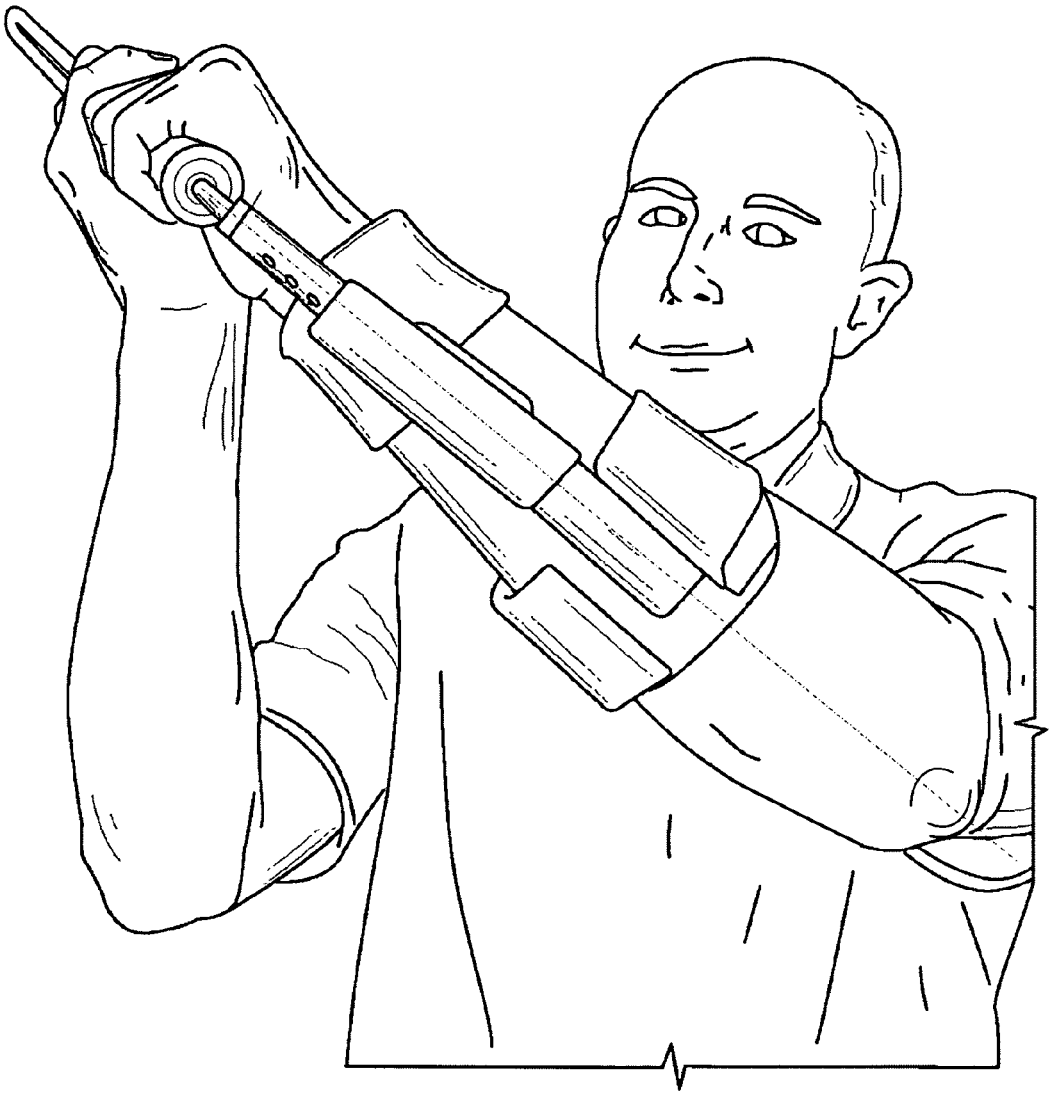
FIG. 18 is substantially a view of a user using an embodiment of the golf swing trainer of the present invention, which includes a training arm and receiver positioned substantially below the user's ulna bone.

In the embodiment where receiver 124 is made separate from the brace body 134, receiver 124 may be attached to the brace body 134 using adhesives known in the art, by sewing, or by other methods of attachment known in the art. A receiver jacket 139 may also be used to attach and hold the receiver 124 next to the brace body 134. In the preferred embodiment, when forearm brace 122 is worn by the user, receiver 124 is preferably positioned substantially proximate to the area directly below the user's ulna bone and substantially in alignment with the user's ulna bone (FIG. 18).

Referring back to FIG. 6, forearm brace 122 may include a wrist block 136. Wrist block 136 is preferably attached to an end of brace body 134 that is configured to be positioned substantially proximate to the user's hand. Wrist block 136 preferably has a shape that may substantially cover the area of the user's hand that is opposite the user's palm. The shape of the wrist block 136 may be varied so long as it can block the wrist from moving forward relative to the forearm. It can be appreciated that with the golf swing trainer 122 of the present invention, the user may move the wrist up and down relative to the arm, but the user may be substantially prohibited from moving the wrist towards the front of the arm.

Figure 7:
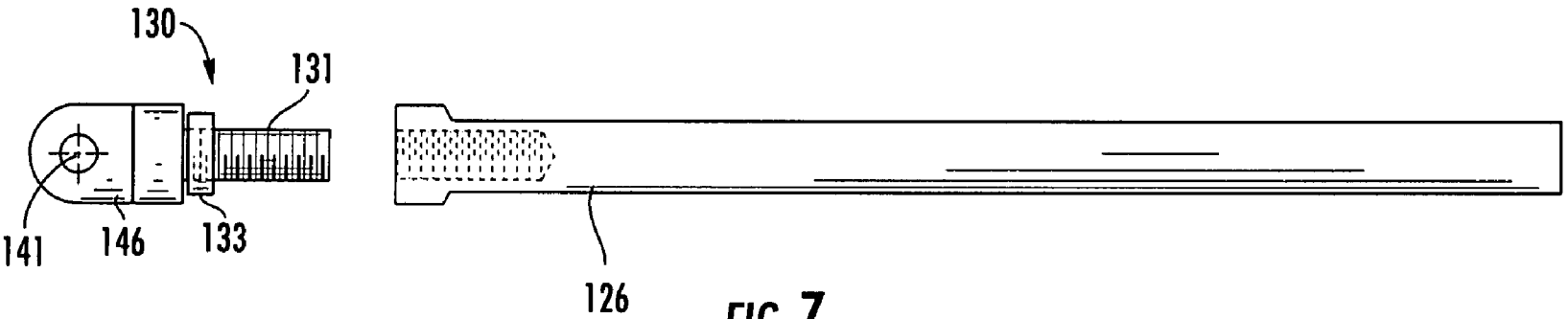
FIG. 7 is substantially a schematic view of the training arm and a training arm wing of the hinge assembly.

Referring now to FIG. 7, hinge assembly 128 preferably includes an arm wing 130 that may be attached to the training arm 126. Arm wing 130 preferably includes an insert portion 131 that may be positioned inside the training arm 126. Arm wing 130 preferably further includes a head portion 146, which is preferably positioned opposite to the insert portion 131. Head portion 146 preferably defines an axle passage 141.

Insert portion 131 may be glued within the interior of training arm 126. Alternatively, insert portion 131 may be threaded, and the portion of the training arm 126 that is configured to receive the insert portion 131 may include a thread receiver to receive a threaded end of the insert portion 131. A jam nut 133 may be provided to affix the insert portion 131 of the arm wing 130 within the training arm 126 and control the placement of the insert portion 131 within the training arm 126.

Figure 8:
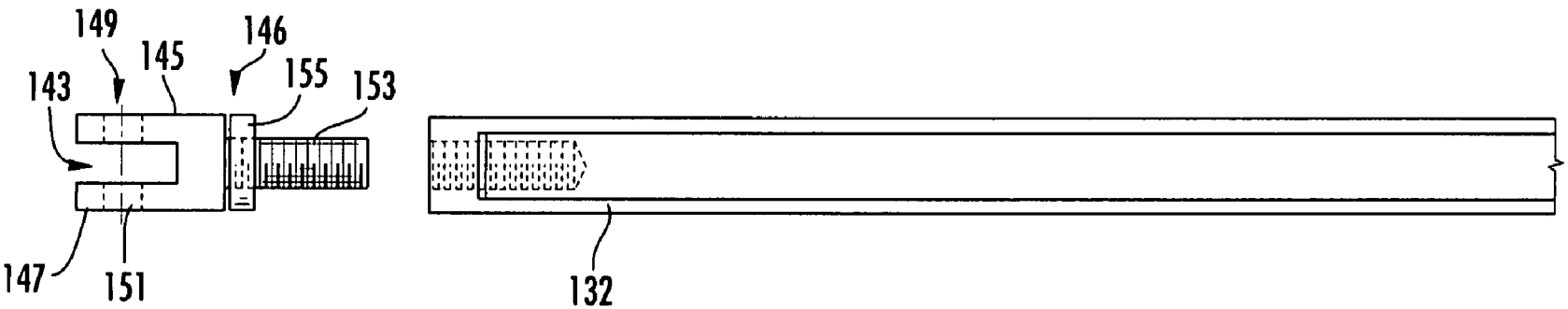
FIG. 8 is substantially a schematic view of the golf club shaft and a golf club shaft wing of the hinge assembly.

Referring now to FIG. 8, hinge assembly 128 preferably also includes a golf club shaft wing 146. Golf club shaft wing 146 is preferably comprised of a shaft wing insert portion 153 and a shaft wing jam nut 155. Shaft wing insert portion 153 is preferably configured to be inserted through the interior of golf club shaft 132 preferably with the walls defining slot 143 parallel and in alignment with the leading edge 45 of the golf club head 36. Shaft wing insert portion 153 is preferably threaded, and the interior of golf club shaft 132 preferably has thread receivers to hold the shaft wing insert portion 153. Alternatively, shaft wing insert portion 153 may not be threaded and may be glued inside the golf club shaft 132. Shaft wing jam nut 155 preferably provides a way to control the placement of the shaft wing insert portion 153 within the golf club shaft 132.

Golf club shaft wing 146 preferably includes an arm wing head receiver 149. Arm wing head receiver 149 preferably includes top and bottom surfaces (145 and 147, respectively)

that define the second axle passage 151. Arm wing head receiver 149 preferably includes substantially a slot 143 in between top surface 145 and bottom surface 147. Slot 143 is preferably U-shaped and is preferably configured to receive a head portion 146 of arm wing 130.

Figure 9:
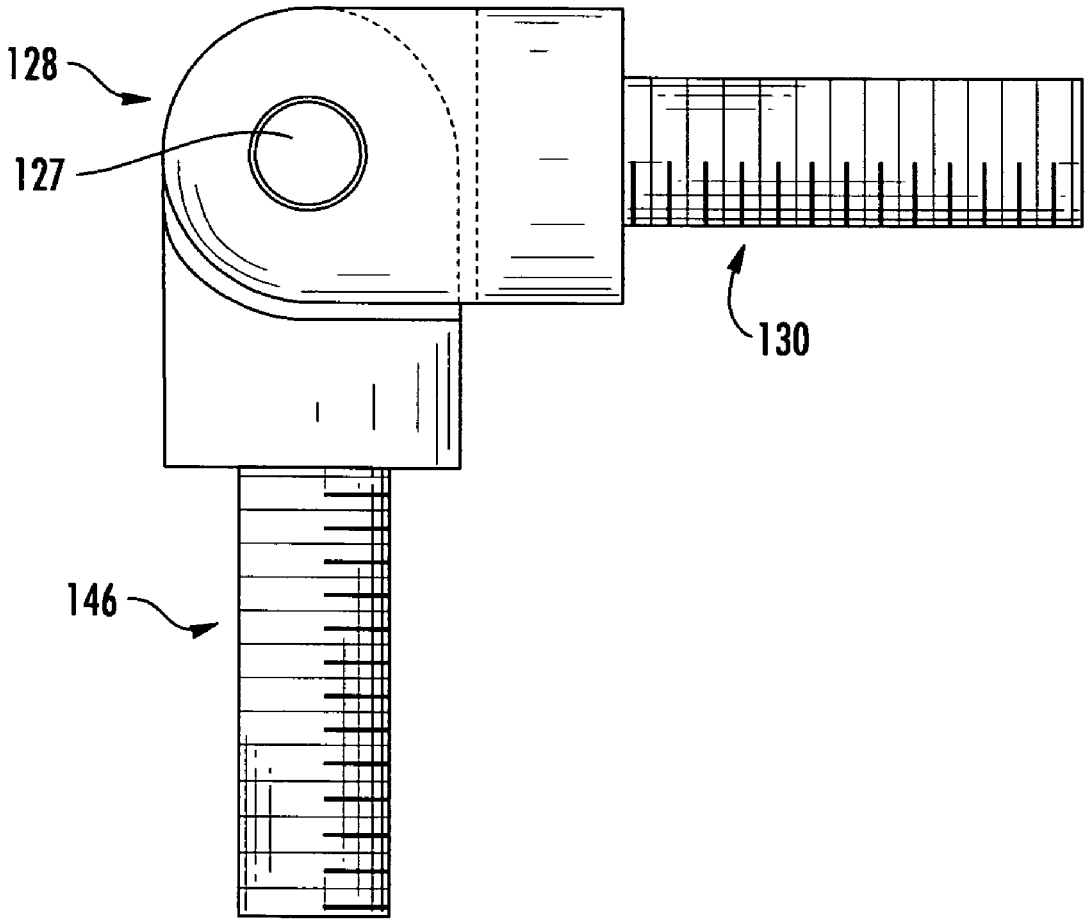
FIG. 9 is substantially a schematic view of a hinge assembly embodiment of the present invention.

Referring now to FIG. 9, axle passage 141 and slot 143 may be aligned so that an axle 127 may be inserted through them to form the hinge assembly 128. Hinge assembly 128 preferably allows the training arm wing 130 and the golf club shaft wing 146 to move at various angles relative to each other. Hinge assembly 128 preferably allows training arm 126 to pivot around the golf club 140 by at least 180 degrees.

Underlying Golf Swing Principle

Before describing the manner in which the golf swing trainer is used, it is beneficial to describe the underlying principle, which the golf swing trainer aims to promote. The golfer's anatomy and the golf club are connected to one another through the hands. The hands are the only part of the anatomy to touch the golf club during the golf swing. Therefore, it can be determined that the hands have the most influence and vital role in swinging the golf club properly.

Figure 16:
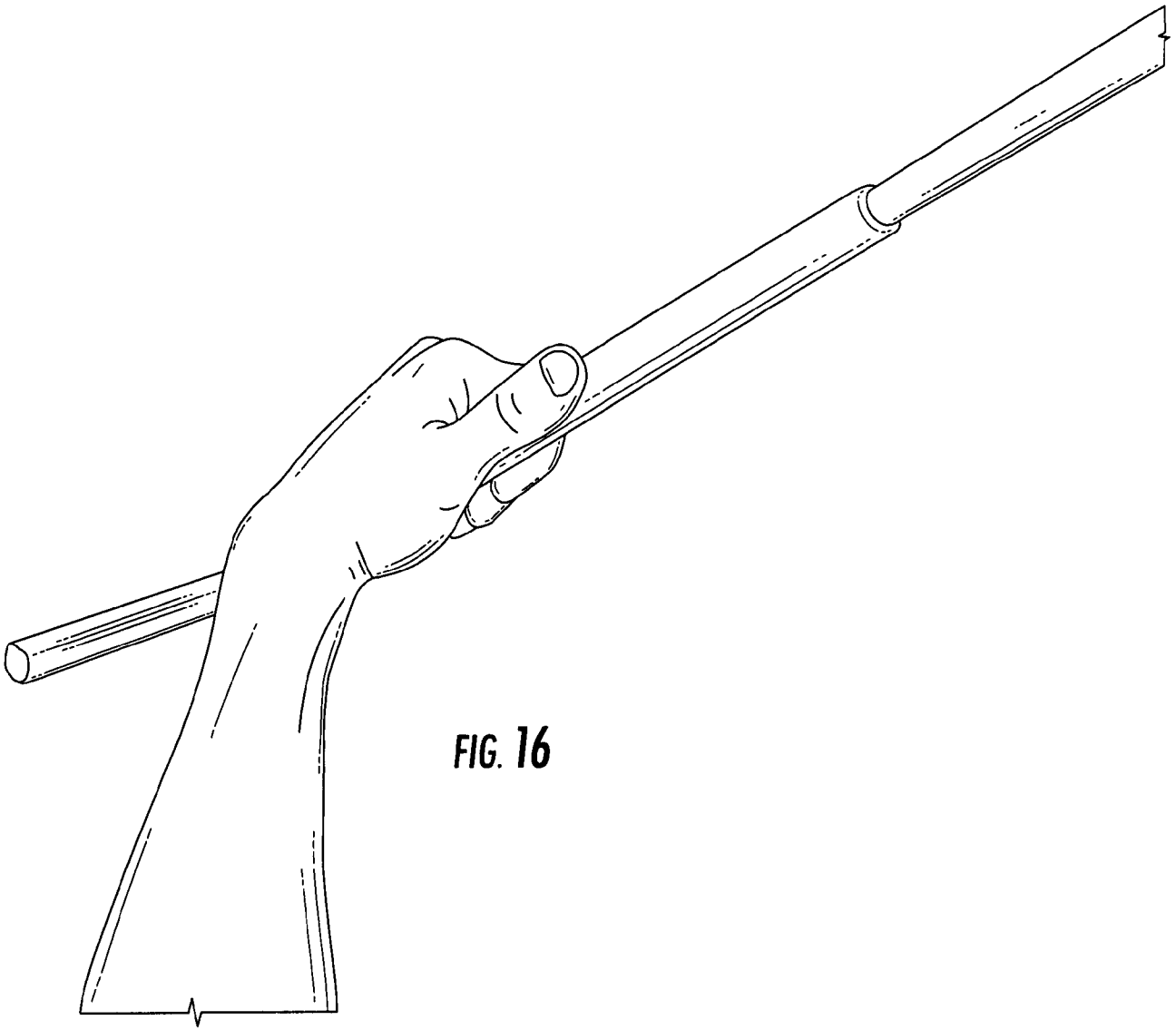
FIG. 16 is substantially a top view of the wrist in one of the undesirable positions.
Figure 17:
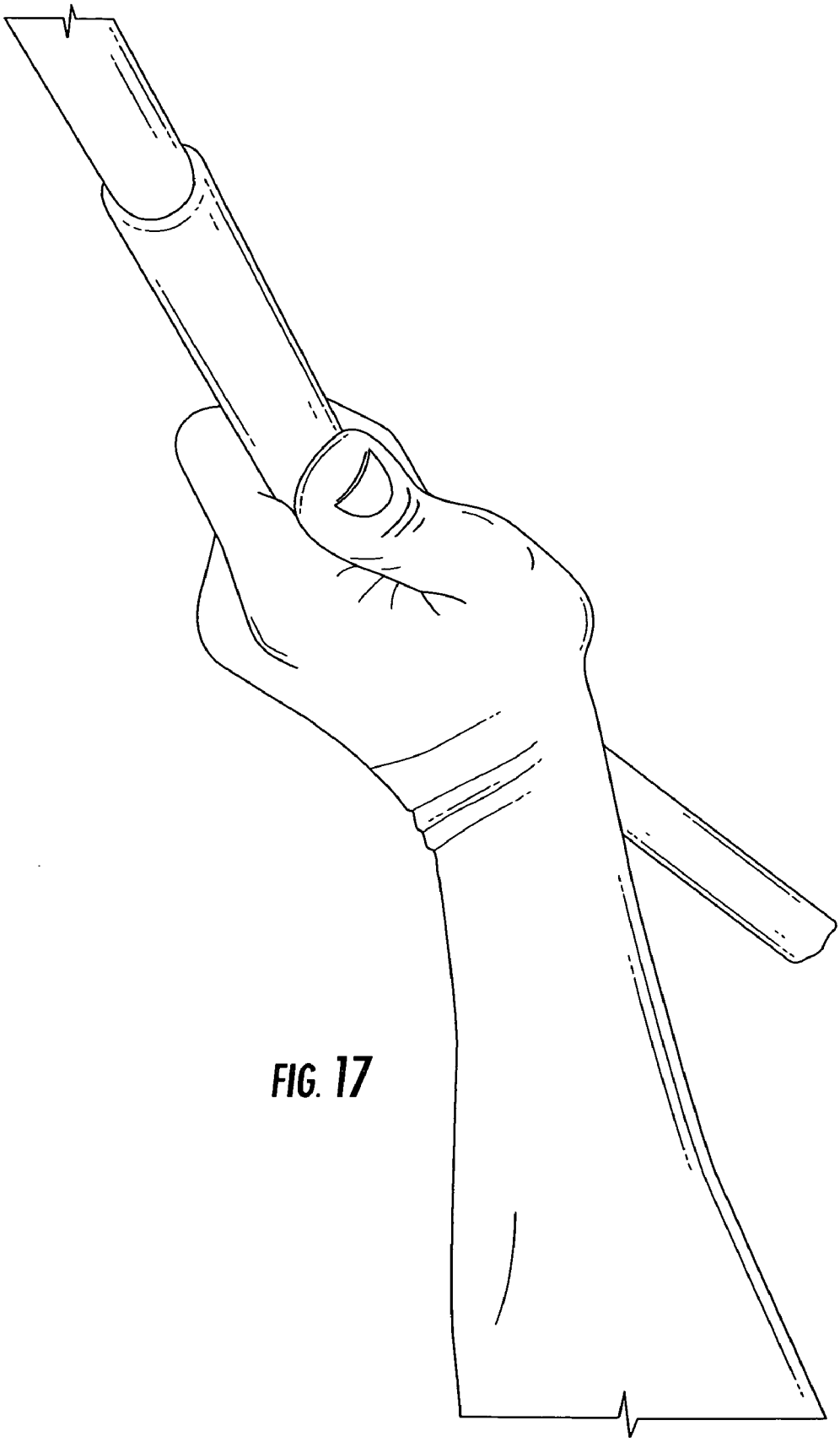
FIG. 17 is substantially a top view of the wrist in one of the undesirable positions.

Upon gripping the golf club correctly, the hands act as the connecting link or hinge between the golfer's anatomy and the golf club. It is the responsibility of the hands to hinge the golf club during the swing. More specifically, the left hand and wrist for a right-handed golfer is the primary hinge. The function of the left wrist is to hinge the golf club in a vertical or up and down fashion. It is undesirable for the left wrist to bend sideways during the swing, as shown in FIGS. 16 and 17. This is especially true when the golf club makes contact with the golf ball.

Figure 15:
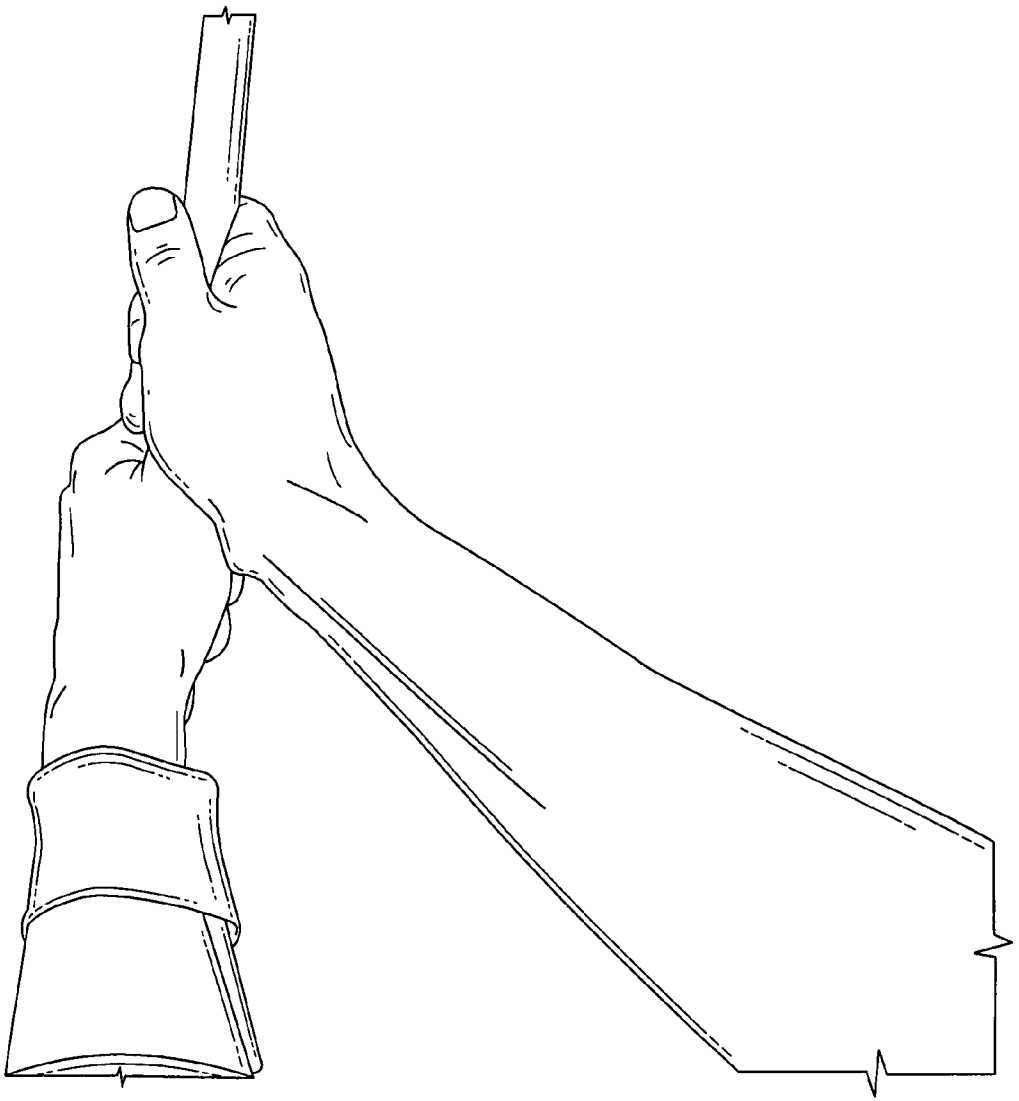
FIG. 15 is substantially a top view of the wrist shown to be in the ideal impact position.

The contact point of the golf ball will be hereinafter referred to as "impact." A neutral or flat left wrist is a desirable position for the left hand to be in at impact (FIG. 15). The term neutral is defined as a natural or unaltered hand in relation to the forearm. For some, this may appear as a slightly angled back of the left hand in relation to the forearm and for others, a relatively parallel back of the left hand to the forearm (FIG. 15).

The impact position of the golf swing is often referred to as the "moment of truth". It is the most critical position of the golf swing. The golf club contacts the ball and remains in contact for a mere ¾ of an inch before separating from one another. It is imperative that the golf club be in a "square" position at this point in the swing in order for the ball to travel straight toward its intended target. The golf club is said to be "square" at impact when the bottom or leading edge is perpendicular to the target line. The target line is an imaginary line FIG. 13*a* drawn from the ball to its intended target before impact.

It is ideal for the golf club to be in a straight line with the left arm at impact. At any point during the golf swing, an "In-Line Condition" exists when the golf club shaft is in a straight line relative to the golfers left arm. When the golf club is in a straight line with the left arm at impact, it will most often result in a neutral or flat left wrist position and "square" clubface as shown as 14*a* in FIG. 14. On the contrary, a bent left wrist at impact will produce an out of line condition and most likely an "open" or "closed" clubface. An "open" clubface is one where the leading edge of the golf club is angled to the right of the intended target and "closed" would be angled to the left. These undesirable clubface positions would result in the ball traveling to the right and left respectively of its intended target and most likely contribute to a high score.

Since the ideal impact position is one where the golf club is in a straight line with the left arm at impact, it would be highly advantageous for the golfer to train themselves to establish and maintain this In-Line Condition throughout the majority of the swing. The golf club will then become an extension of the left arm with the left wrist acting as the connecting link, maintaining its neutral position, and hinging the golf club in a vertical manner.

The correct hinging and unhinging of the left wrist is a critical factor for maximizing the compression of the golf ball at impact. When the left wrist unhinges precisely at the bottom of the arc, maximum compression can occur. When the left wrist unhinges fully and in-line with the left arm, it becomes somewhat arched. This arching of the wrist cannot occur if the left hand is bent forward or out of line with the left arm. When the wrist is in this unhinged or arched position, it is most likely for the back of the left hand to be relatively flat to the forearm. It is desirable that the left wrist be in this flat position upon impact with the golf ball. The inventor has created a device, which will educate a golfer to swing the golf club correctly in this manner.

Manner of Use

Figure 10:
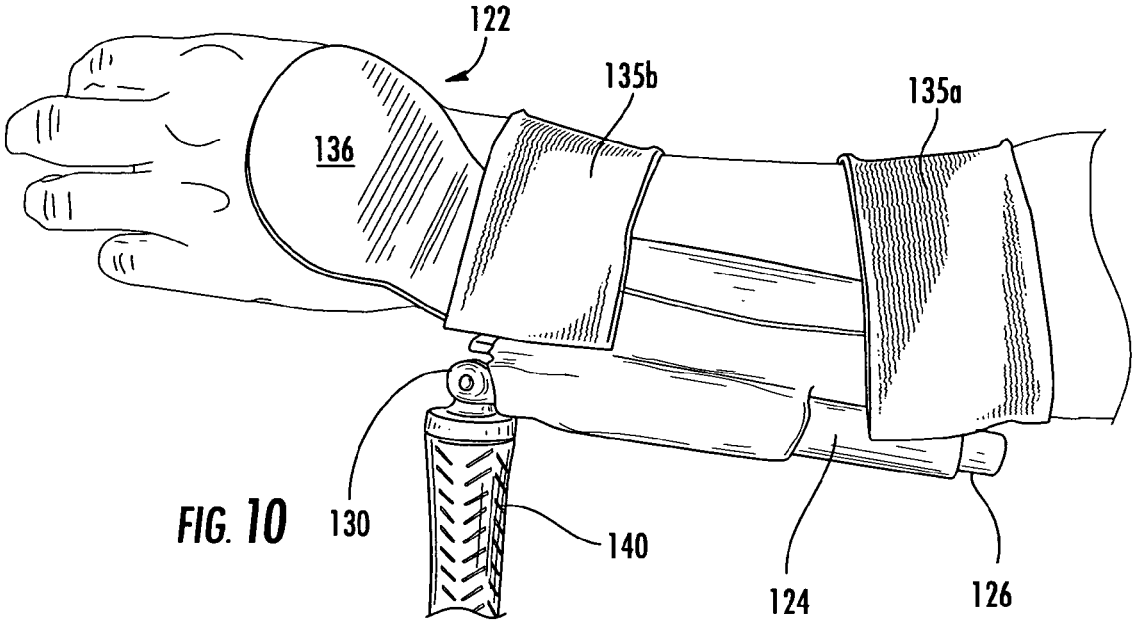
FIG. 10 is substantially a side view of the golf swing trainer embodiment shown as being worn by a user.
Figure 11:
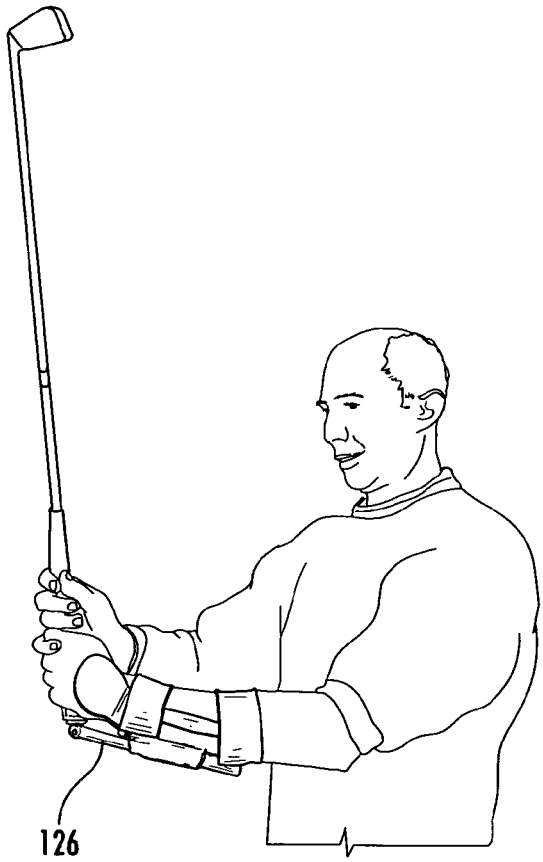
FIG. 11 is substantially a side view of the golf swing trainer embodiment shown as being held by the user.

With reference to FIG. 10, the user may wear the forearm brace 122 by introducing the user's forearm inside the half-pipe structure of the forearm brace 122, positioning the wrist block 136 in front of the user's hand, positioning the receiver 124 substantially close to and below the user's ulna bone (FIG. 18), wrapping the straps 135*a* and 135*b* around the user's arm, and securing straps 135*a* and 135*b* to their corresponding fasteners. The user may then insert the training arm 126 through the receiver 124, grasp the golf club 140, and assume a grip position (FIG. 11). It is noted that the training arm 126 may slide forward towards the user's wrist when the user assumes the grip position in FIG. 11.

Figure 12:
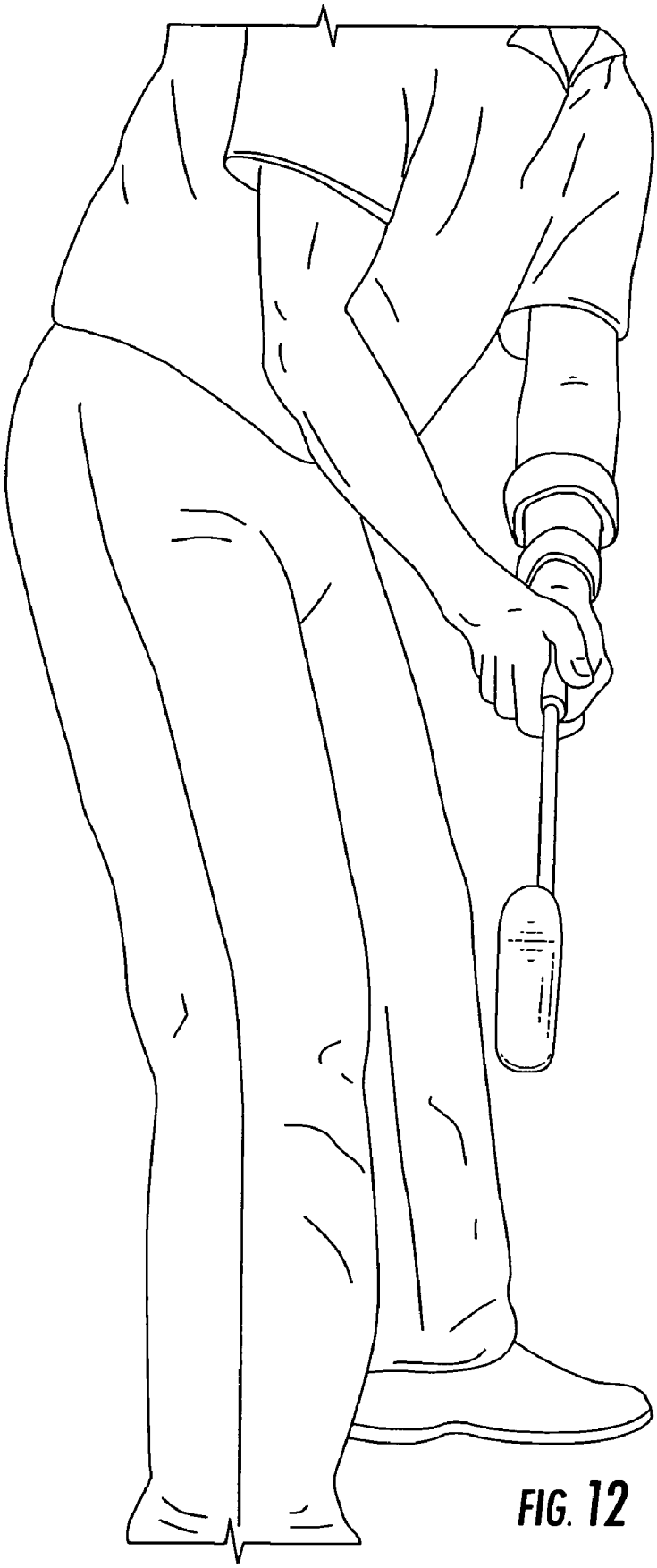
FIG. 12 is substantially a view of the user initiating a backswing with the golf swing trainer embodiment.

Referring now to FIG. 12, the user may perform a golf backswing with the golf swing trainer 120. It can be appreciated that the in-line condition is observed from the beginning of the swing. The golfer's arm, the shaft, and the leading edge of the club can be observed as being in a single plane. The In-line condition is formed between the golfer's left arm and the club shaft. The golfer's left arm can be further and more specifically defined with reference to the ulna bone. Keeping the golf club in-line with the ulna bone of the golfer's left arm at the beginning of the swing promotes a proper "one-piece takeaway."

Figure 13:
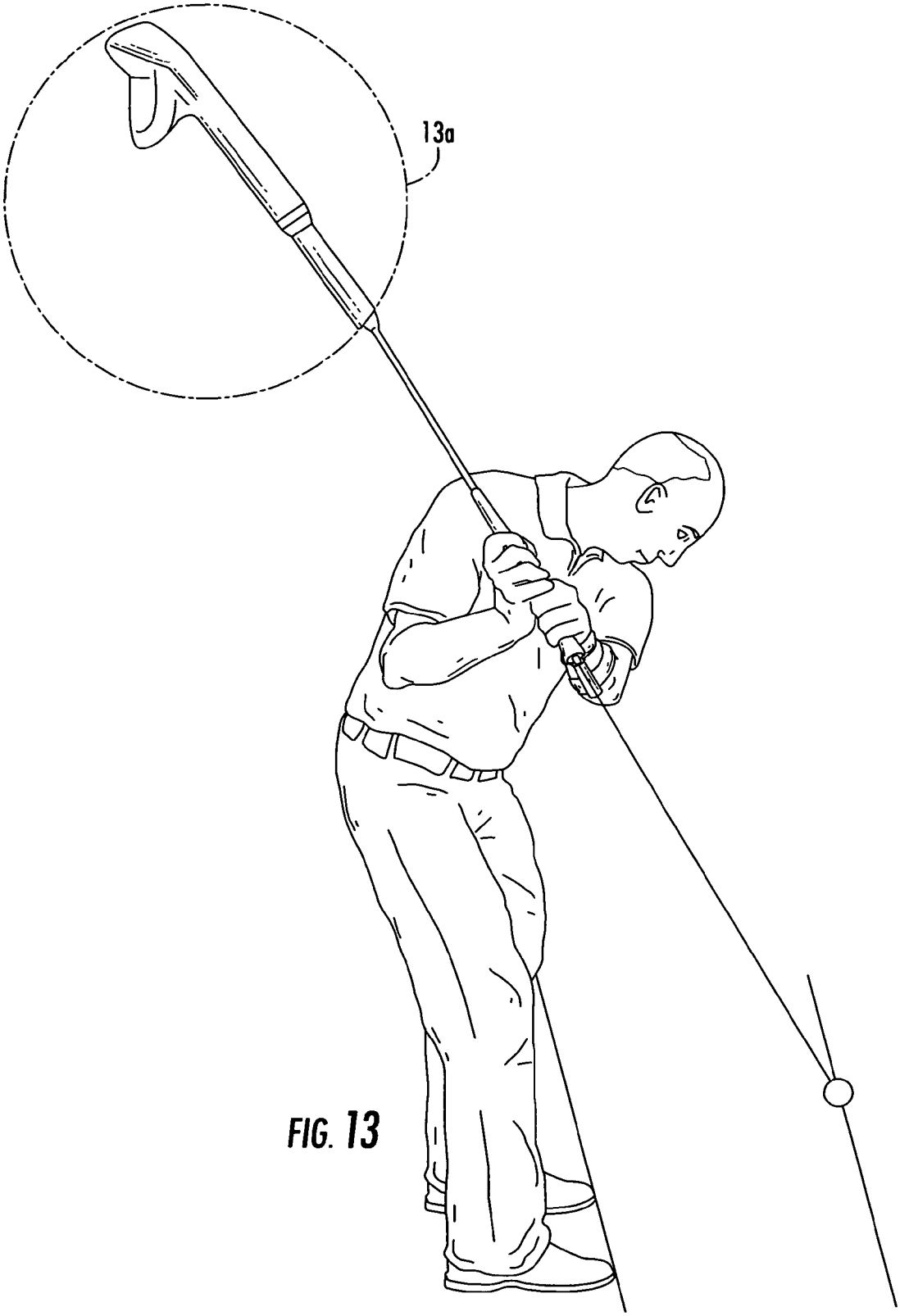
FIG. 13 is substantially a side view of the user with the golf swing trainer embodiment near the top of the backswing and a partial close-up 13*a* of the golf club head.

Referring now to FIG. 13, it can be appreciated that the golf swing trainer 120 preserves the in-line condition at the midway point of the backswing. The golfer's left arm has titled or rotated clockwise in response and corresponding to the angular momentum generated by the swinging of the golf club head on an inclined plane. The wrists are considered to be "hinged" to approximately 90 degrees. This up and down or vertical hinging of the wrist does not compromise the in-line condition because the golf club shaft has titled clockwise an amount equal to the forearm rotation. The golf club shaft is said to be "on plane" because the shaft points to the target line and intersects the golfer's right shoulder. Note the golf club leading edge 13*a* is square to this plane also. Thus, it can be determined that the terms "in-line" and "on-plane" are synonymous. The construction of the golf swing trainer 120 ensures that when the user swings the golf club, the shaft tilt, regardless of the amount, will result in an equal rate of forearm tilt or rotation. It can be determined that the swing trainer promotes the correct degree of forearm rotation at various points during the swing.

Figure 14:
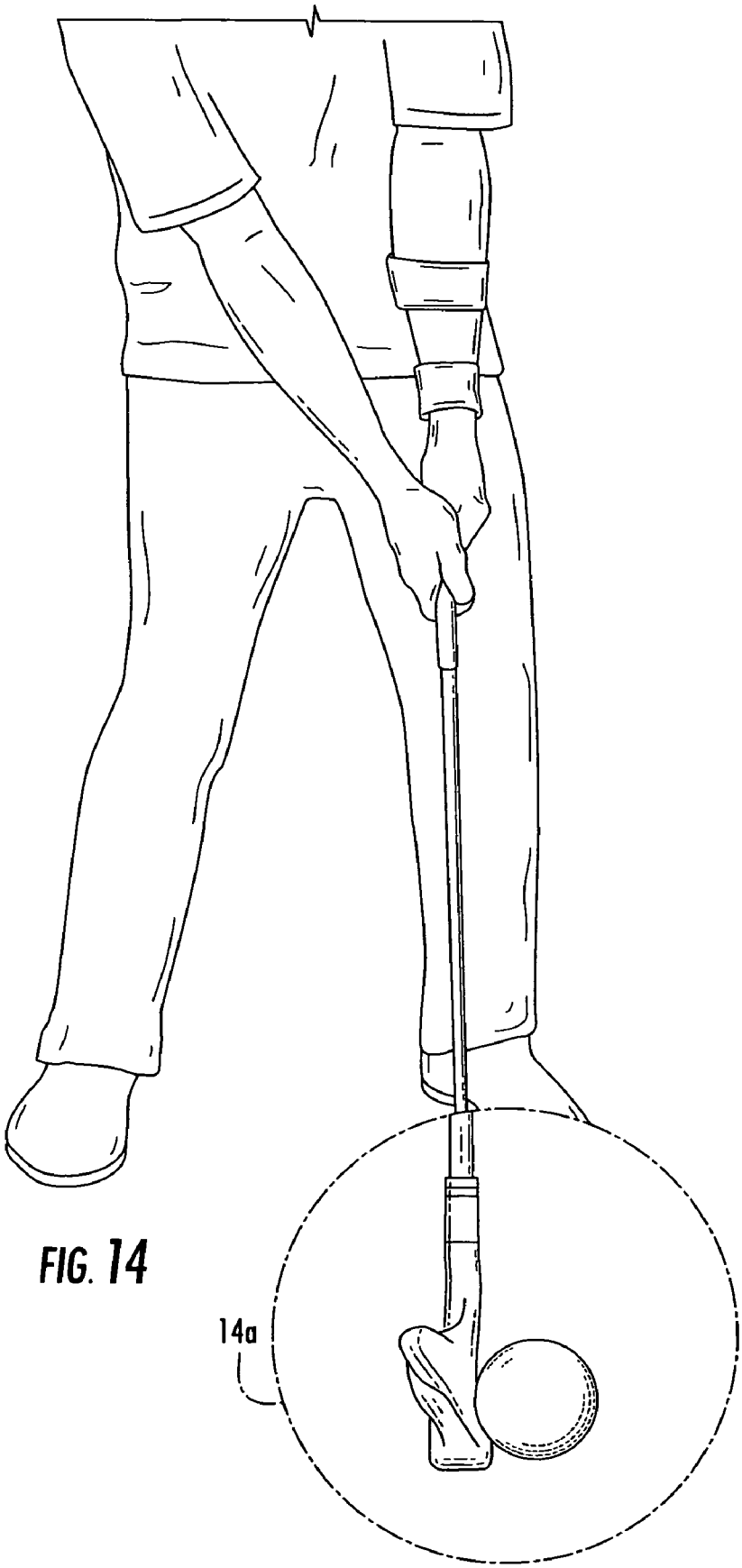
FIG. 14 is substantially a front view of the user of the golf swing trainer embodiment at the impact position and a partial close-up of the golf club head at the impact position.

Referring now to FIG. 14, the golfer is shown wearing the golf swing trainer 120 at the impact position of the swing. The shaft of the golf club is in-line with the ulna bone area of the golfer's left arm. The left wrist is considered "unhinged" in this position creating the flat condition described earlier.

Thus, it can be appreciated that the golf swing training device of the present invention aids the golfer to achieve this ideal position at impact. It can be determined that when the golfer hinges and unhinges the golf club shaft in-line with the left arm, it produces a neutral to flat left wrist position respectively.

It can also be appreciated that the golf swing trainer prevents a bowed left wrist position as shown in FIG. 16. This undesirable left wrist position would likely lead to an incorrect closed position of the golf club head. A closed club head is defined as a fundamentally incorrect position where the leading edge of the club head would be rotated counterclockwise from the desired square position at any point during the golf swing. This position is avoided with the user wearing the golf swing trainer because it would not allow the training arm to be out of line with the ulna bone as shown in FIG. 16.

It can further be appreciated that the golf swing trainer prevents a cupped left wrist position as shown in FIG. 17. This undesirable left wrist position would likely lead to an incorrect open position of the golf club head. An open club head is defined as a fundamentally incorrect position where the leading edge of the club head would be rotated clockwise from the desired square position at any point during the golf swing. This position is avoided with the user wearing the golf swing trainer because it would not allow the training arm to be out of line with the ulna bone as shown in FIG. 17.

It can further be realized that the golf swing training device 20 reveals the simplicity of the proper swing. The golf swing training device 20 helps the user feel the harmony of a proper swing. The user will most likely achieve correct square position at impact with the golf swing trainer 20, as the correct inclined plane is observed on the backswing and as the golf club shaft and the forearm are kept in substantially the same plane on the backswing.

On the downswing and follow through, the user may appreciate that the golf swing trainer 20 helps promote using golf club as an extension of the left arm. The golf swing trainer 20 may be used to teach users to unhinge the wrist properly on the downswing and keep the wrist flat at impact. The golf swing trainer 20 may be used to get the user accustomed to swinging the golf club shaft 132 that is in the same plane as the forearm.

Thus, it can now be realized that certain embodiments of the present invention provide a golf swing trainer that is effective in educating users how to: establish and maintain an in-line condition throughout the majority of the golf swing by maintaining a constant relationship between the ulna bone area of the golfer's forearm and the golf club shaft; promote the proper degree of forearm rotation during the swing; execute a one-piece take away, how to keep the golf club shaft on plane and square golf club head during the entire swing; maintain proper club head path; achieve consistent impact position and square club head at impact; and, how to hinge the wrist correctly during the swing. The golf swing trainer teaches the user how to execute a swing with a smooth athletic motion. Certain embodiments of the invention provide a swing trainer that trains the golfer's left wrist to be in a neutral to flat position and makes it difficult or uncomfortable to be otherwise.

Certain embodiments of the present invention, along with its construction, have preventive benefits. The golf swing training device prevents the golf club shaft from getting out of line with the ulna bone area of the golfer's left arm throughout the majority of the golf swing which would cause the golf club to veer of the proper plane. It prevents golfers from developing fundamentally incorrect habits of "cupping" or "bowing" the left wrist which can lead to numerous detrimental errors and will often lead to a higher score. It prevents the golf club head from getting into an incorrect "open" or "closed" position at any point during the swing which would result in inaccurate shots to the right and left respectively.

Certain embodiments also provide a golf swing trainer that is easy to use and easy to store. Certain embodiments further provide a golf swing trainer that is easy to manufacture. It can further be appreciated that certain embodiments provide a trainer that may be installed with existing golf clubs of users.

Although the description above contains many specifications, these should not be construed as limiting the scope of the invention but as merely providing illustrations of some of the presently preferred embodiments of this invention. For instance, the sizes, materials, and placements of straps around the brace may vary. The sizes, shapes, locations, and the materials of the training arm, the hinge assembly, and the receiver may vary. Thus, the scope of the invention should be determined by the appended claims and their legal equivalents rather than by the examples given.

What is claimed is:

1. A golf swing trainer for use by a user having a forearm including an ulna bone, the golf swing trainer comprising:

a golf club including:

a shaft having a club head end portion and an opposing grip end portion; and a club head connected to the club head end portion, the club head including a club face having a leading edge, the leading edge defining a leading edge axis;

a hinge connected to the grip end portion of the golf club shaft;

a mechanical arm connected to the hinge to enable pivotal motion of the mechanical arm relative to the golf club shaft within a single pivotal plane aligned with the leading edge axis; and a forearm brace configured to be attachable to the forearm of the user, the forearm brace being engageable with the mechanical arm to align the mechanical arm with the forearm of the user.

2. The golf swing trainer as recited in claim 1, wherein the forearm brace includes a mechanical arm receiver configured to engage with the mechanical arm.

3. The golf swing trainer as recited in claim 2, wherein the mechanical arm is moveably positioned within the mechanical arm receiver.

4. The golf swing trainer as recited in claim 2, wherein the mechanical arm receiver is configured to circumferentially engage with the mechanical arm.

5. The golf swing trainer as recited in claim 1, wherein the forearm brace is configured to align the mechanical arm with the ulna bone of the user when the mechanical arm is engaged with the forearm brace.

6. A golf swing trainer for use with a golf club including a shaft having a club head end portion and an opposing grip end portion and a club head connected to the club head end portion, the club head including a club face having a leading edge, the leading edge defining a leading edge axis, the golf swing trainer configured for use by a user having a forearm including an ulna bone, the golf swing trainer comprising:

a hinge mountable to the grip end portion of the golf club shaft;

a mechanical arm connected to the hinge to enable pivotal motion of the mechanical arm relative to the golf club shaft within a single pivotal plane aligned with the leading edge axis; and a forearm brace configured to be attachable to the forearm of the user, the forearm brace being engageable with the mechanical arm to align the mechanical arm with the forearm of the user.

7. The golf swing trainer as recited in claim 6, wherein the forearm brace includes a mechanical arm receiver configured to engage with the mechanical arm.

8. The golf swing trainer as recited in claim 7, wherein the mechanical arm is moveably positioned within the mechanical arm receiver.

9. The golf swing trainer as recited in claim 7, wherein the mechanical arm receiver is configured to circumferentially engage with the mechanical arm.

10. The golf swing trainer as recited in claim 6, wherein the forearm brace is configured to align the mechanical arm with the ulna bone of the user when the mechanical arm is engaged with the forearm brace.

11. A golf swing trainer for use by a user having a forearm including an ulna bone, the golf swing trainer comprising:

a golf club including:

a shaft having a club head end portion and an opposing grip end portion; and a club head connected to the club head end portion, the club head including a club face having a leading edge, the leading edge defining a leading edge axis;

a mechanical arm pivotally mounted to the grip end portion of the shaft, the mechanical arm being pivotal within a single pivotal plane aligned with the leading edge axis; and a forearm brace configured to be attachable to the forearm of the user, the forearm brace being engageable with the mechanical arm to align the mechanical arm with the forearm of the user.

12. The golf swing trainer as recited in claim 11, further including a hinge pivotally connecting the mechanical arm and the golf club shaft.

13. The golf swing trainer as recited in claim 12, wherein the hinge is configured to substantially limit the pivotal motion of the mechanical arm to the single pivotal plane.

14. The golf swing trainer as recited in claim 11, wherein the mechanical arm is telescopically attached to the golf club shaft to allow for extension and retraction of the mechanical arm as the user executes the golf swing.

15. The golf swing trainer as recited in claim 11, wherein the forearm brace includes a mechanical arm receiver configured to engage with the mechanical arm.

16. The golf swing trainer as recited in claim 15, wherein the mechanical arm is moveably positioned within the mechanical arm receiver.

17. The golf swing trainer as recited in claim 11, wherein the forearm brace is configured to align the mechanical arm with the ulna bone of the user when the mechanical arm is engaged with the forearm brace.

18. A golf swing trainer for use with a golf club including a shaft having a club head end portion and an opposing grip end portion and a club head connected to the club head end portion, the club head including a club face having a leading edge, the leading edge defining a leading edge axis, the golf swing trainer configured for use by a user having a forearm including an ulna bone, the golf swing trainer comprising:

a mechanical arm pivotally mountable to the grip end portion of the shaft, the mechanical arm being pivotal within a single pivotal plane aligned with the leading edge axis when mounted to the grip end portion of the shaft; and a forearm brace configured to be attachable to the forearm of the user, the forearm brace being engageable with the mechanical arm to align the mechanical arm with the forearm of the user.

19. The golf swing trainer as recited in claim 18, wherein the mechanical arm is pivotally mountable to the grip end portion of the shaft via a hinge.

20. The golf swing trainer as recited in claim 18, wherein the mechanical arm is telescopically attached to the golf club shaft to allow for extension and retraction of the mechanical arm as the user executes the golf swing.

21. The golf swing trainer as recited in claim 18, wherein the forearm brace includes a mechanical arm receiver configured to engage with the mechanical arm.

22. The golf swing trainer as recited in claim 21, wherein the mechanical arm is moveably positioned within the mechanical arm receiver.

* * * * *